US006883681B1

(12) United States Patent
Coughlin et al.

(10) Patent No.: US 6,883,681 B1
(45) Date of Patent: Apr. 26, 2005

(54) AUTOMATIC DISPENSING SYSTEM FOR UNIT MEDICAMENT PACKAGES

(75) Inventors: Michael E. Coughlin, Overland Park, KS (US); Arpita Banerjee, Olathe, KS (US); Lawrence E. Guerra, Roeland Park, KS (US); Keith W. Kudera, Merriam, KS (US); Ronald A. Leonard, Peculiar, MO (US); Hamid Massali, Leawood, KS (US); David M. McDonald, Kansas City, KS (US); Fred T. Steinbach, Olathe, KS (US); Tim Surgeon, Archie, MO (US)

(73) Assignee: ScriptPro LLC, Mission, KS (US)

( * ) Notice: Subject to any disclaimer, the term of this patent is extended or adjusted under 35 U.S.C. 154(b) by 421 days.

(21) Appl. No.: 09/457,286

(22) Filed: Dec. 8, 1999

Related U.S. Application Data

(60) Provisional application No. 60/111,896, filed on Dec. 10, 1998.

(51) Int. Cl.[7] ..... G07F 11/00

(52) U.S. Cl. ..... 221/123; 221/124; 221/129; 221/130; 221/131; 221/133; 414/268; 414/278; 414/285

(58) Field of Search ..... 221/123, 124, 221/129, 130, 131, 133, 9, 13, 14, 6; 209/576, 577, 586, 587; 414/268, 269, 270, 278, 285

(56) References Cited

U.S. PATENT DOCUMENTS

| | | | | |
|---|---|---|---|---|
| 1,128,561 A | | 2/1915 | Webendorfer | |
| 2,690,856 A | | 10/1954 | Trondle | |
| 3,719,288 A | * | 3/1973 | Schmitt et al. | 198/597 |
| 3,746,211 A | | 7/1973 | Burgess, Jr. | |
| 4,284,301 A | | 8/1981 | Geiger et al. | |
| 4,660,824 A | | 4/1987 | Hermkens et al. | |

(Continued)

FOREIGN PATENT DOCUMENTS

| | | |
|---|---|---|
| DE | 29607940 U1 | 5/1996 |
| EP | 282785 A | 9/1988 |
| JP | 53145260 | 12/1978 |
| JP | 5943743 A | 10/1984 |
| JP | 09259344 A | 10/1997 |
| JP | 11296727 A | 10/1999 |
| SU | 918086 | 4/1982 |

*Primary Examiner*—Donald P. Walsh
*Assistant Examiner*—Jeffrey Shapiro
(74) *Attorney, Agent, or Firm*—Hovey Williams LLP

(57) ABSTRACT

A storage and dispensing system (10) for storing and dispensing pre-packaged pharmaceutical products (12) and other products. The system includes a cabinet (14); a plurality of product conveyors (16) mounted within the cabinet and each configured for holding at least one product; an infeed conveyor (18) for receiving products that are to be stored in the cabinet; an outfeed conveyor (20) for receiving products that are to be dispensed from the cabinet; and a transporter (22) moveable within the cabinet for transporting products between the product conveyors and the infeed and outfeed conveyors for storing products in or dispensing products from the cabinet.

23 Claims, 13 Drawing Sheets

U.S. PATENT DOCUMENTS 4,753,473 A 6/1988 Arnett
4,787,803 A * 11/1988 van Elten et al. ..... 198/774.4
4,810,230 A 3/1989 Shirasawa
4,812,629 A * 3/1989 O'Neil et al. ..... 235/383
4,872,803 A 10/1989 Asakawa
4,902,263 A 2/1990 Ito et al.
5,082,268 A 1/1992 Santoro
5,137,145 A * 8/1992 Clopton ..... 198/860.2
5,174,707 A * 12/1992 Suekane et al. ..... 414/269
5,332,275 A 7/1994 Conway et al.
5,337,919 A 8/1994 Spaulding et al.
5,364,220 A * 11/1994 Killinger ..... 414/272
5,536,128 A * 7/1996 Shimoyashiro et al. ..... 414/273
5,582,497 A * 12/1996 Noguchi ..... 414/281
5,664,928 A * 9/1997 Stauber ..... 414/269
5,692,292 A * 12/1997 Asai et al. ..... 29/740
5,699,262 A * 12/1997 Lang et al. ..... 364/478.01
5,713,487 A 2/1998 Coughlin
5,762,235 A 6/1998 Coughlin
5,798,020 A 8/1998 Coughlin et al.
5,860,563 A 1/1999 Guerra et al.
5,873,488 A 2/1999 Guerra
5,897,024 A 4/1999 Coughlin et al.
5,924,549 A * 7/1999 Risley ..... 198/416
5,955,857 A * 9/1999 Kwon et al. ..... 318/568.11
5,988,858 A * 11/1999 Yuyama et al. ..... 364/478.17
6,006,946 A * 12/1999 Williams et al. ..... 221/9
6,440,178 B1 * 8/2002 Berner et al. ..... 29/25.01
6,470,234 B1 * 10/2002 McGrady ..... 700/241
6,692,211 B1 * 2/2004 Yuyama et al. ..... 414/278

* cited by examiner

AUTOMATIC DISPENSING SYSTEM FOR UNIT MEDICAMENT PACKAGES

RELATED APPLICATION

This application claims the priority benefit of provisional application entitled Automatic Dispensing System for Unit Medicament Packages, Ser. No. 60/111,896, filed Dec. 10, 1998, incorporated into the present application by reference.

BACKGROUND OF THE INVENTION

1. Field of the Invention

The present invention relates to the field of medicament dispensing systems. More particularly, the invention relates to a system for automatically storing and dispensing pre-packaged pharmaceutical products and other products.

2. Description of the Prior Art

Pharmacists spend an increasing amount of their time at work educating patients about the proper use and handling of medicaments and pharmaceuticals. While this trend toward more patient counseling increases patients' knowledge about medicaments and decreases improper use of the medicaments, it leaves less time for pharmacists to fill and dispense the medicaments.

Automatic medicament dispensing systems, such as the one disclosed in U.S. Pat. No. 5,337,919 (hereinafter referred to as the "'919 patent"), have been developed to assist pharmacists in the filling and dispensing of prescriptions and to therefore have more time for patient counseling. The system described in the '919 patent is extremely effective for filling and dispensing medicaments in the form of pills and capsules, but is not designed to dispense larger pre-packaged pharmaceuticals. Pharmacists in many areas dispense large quantities of pre-packaged boxes and/or bottles of pharmaceuticals and currently must manually locate and dispense these items, reducing the amount of time the pharmacists have for patient counseling.

Another problem with manually locating and dispensing pre-packaged pharmaceuticals is that errors are sometimes made. For example, because many boxes of pre-packaged pharmaceuticals look alike even though they have different strengths or quantities of medicaments therein, pharmacists occasionally locate and dispense the wrong box. Such errors can obviously have serious consequences for the patients receiving the products.

Accordingly, there is a need for an improved medicament dispensing system that overcomes the limitations of the prior art. More particularly, there is a need for a medicament dispensing system for automatically storing and dispensing pre-packaged pharmaceutical boxes and/or bottles and other products so that pharmacists will have more time for patient counseling and will not make errors while manually dispensing the products.

OBJECTS AND SUMMARY OF THE INVENTION

The present invention solves the above-described problems and provides a distinct advance in the art of automatic medicament dispensing systems. More particularly, the present invention provides a medicament dispensing system configured for storing and dispensing pre-packaged pharmaceutical products such as inhalants, eye preparations, cream-based medications in tubes, birth control pills, syringes, patch-based medications, injectables, gauze, bottles of pills, liquids, powders, creams, or capsules, trays, supplies and other products. The system of the present invention may also be used to store and dispense pre-filled bottles or vials of medicaments filled by an automatic medicament dispensing system such as the SP 200 medicament dispensing system manufactured and sold by ScriptPro LLC of Mission, Kans.

The medicament dispensing system of the present invention broadly includes a cabinet; a plurality of product conveyors mounted within the cabinet and each configured for holding at least one product; an infeed conveyor for receiving products that are to be stored in the cabinet; an outfeed conveyor for receiving products that are to be dispensed from the cabinet; a transporter moveable within the cabinet for transporting products between the product conveyors and the infeed and outfeed conveyors for storing products in or dispensing products from the cabinet; and a control system that controls operation of the various conveyors and transporter to dispense products from the cabinet in response to prescriptions received from a host computer.

The control system includes a controller that maintains or accesses databases or tables which record the identification, location and status of all products and conveyors within the cabinet. When the controller receives a prescription to be filled from the host computer, it accesses the databases to locate a product or products that fill the prescription and then directs the conveyors and transporter to find and dispense the products. The control system may also include a bar code scanner, a label printer, a keypad, and a operator interface screen for permitting an operator to scan bar code labels on the products as they are being loaded into the cabinet and after they are dispensed from the cabinet and for printing prescription labels for the products.

The medicament dispensing system of the present invention significantly reduces the amount of time that a pharmacist or other operator spends on filling and dispensing prescriptions for pre-packaged pharmaceuticals and therefore allows the pharmacist to spend more time counseling patients. Moreover, the system eliminates errors associated with manual filling and dispensing of pre-packaged pharmaceuticals.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
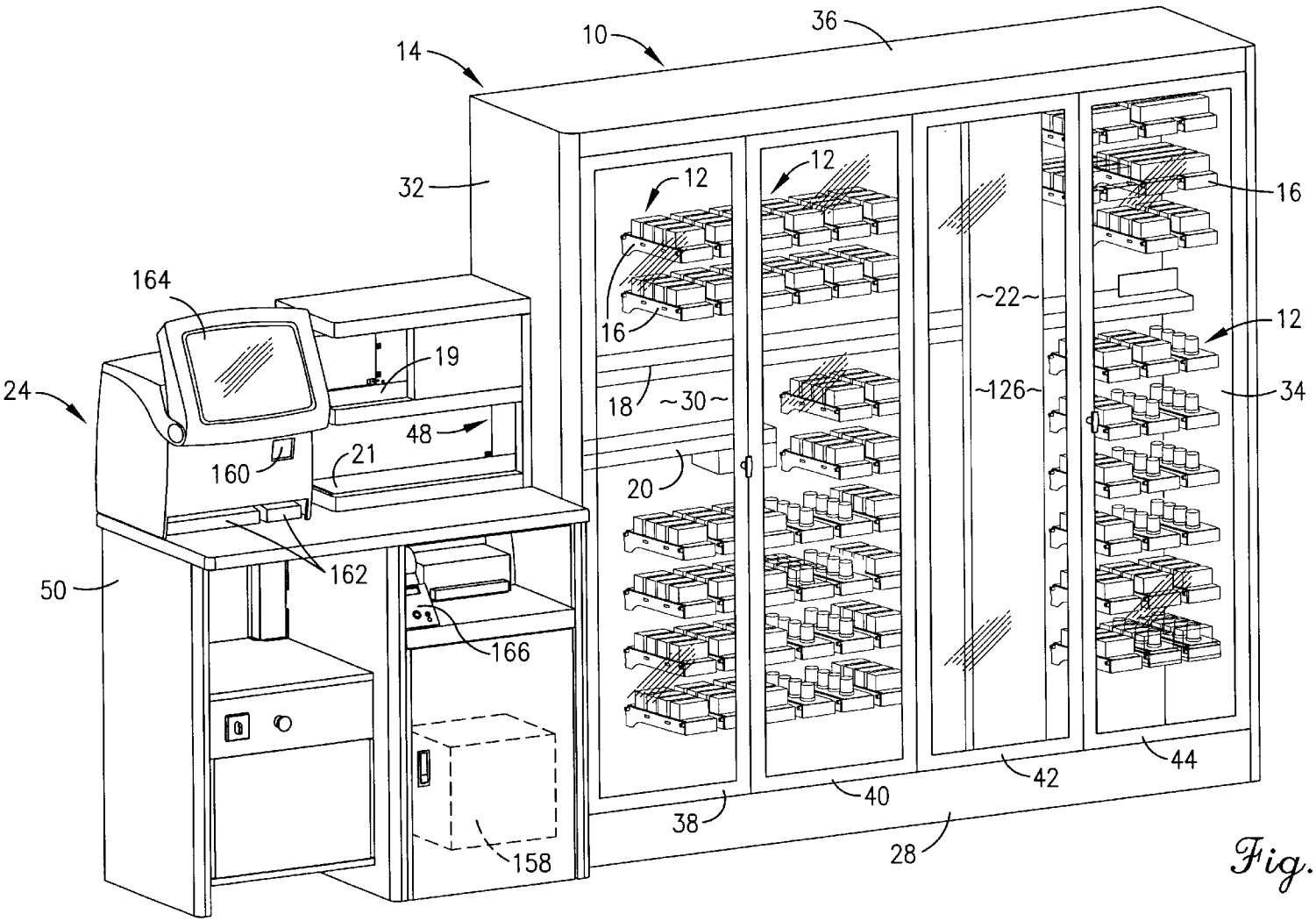
FIG. 1 is a perspective view of a medicament dispensing system constructed in accordance with a preferred embodiment of the present invention.
Figure 18:
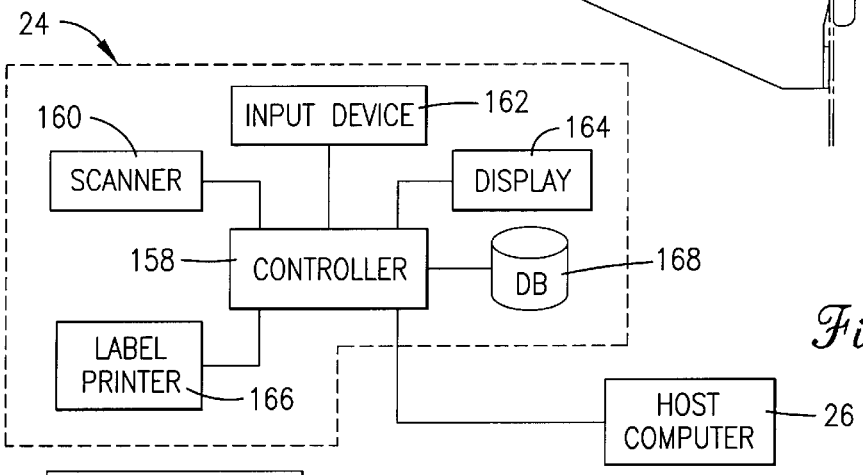
FIG. 18 is a schematic diagram of the components of the control system.

Turning now to the drawing figures, and particularly FIG. 1, a medicament storage and dispensing system 10 constructed in accordance with a preferred embodiment of the invention is illustrated. The system is operable for storing and dispensing products 12 such as pre-packaged pharmaceutical boxes and/or bottles and broadly includes a cabinet 14; a plurality of product conveyors 16 mounted within the cabinet and each configured for holding at least one product thereon; an infeed conveyor 18 for transporting products into the cabinet; an outfeed conveyor 20 for transporting products out of the cabinet; a transporter 22 (FIG. 3) moveable within the cabinet for transporting products between the product conveyors and the infeed and outfeed conveyors; and a control system 24 for controlling operation of the conveyors and the transporter in response to prescriptions (scripts) received from a host computer 26 (FIG. 18).

Cabinet

In more detail, the cabinet 14 encloses and supports the conveyors 16, 18, 20 and transporter 22 and includes a front wall 28, a rear wall 30, a left side wall 32 (as viewed in FIG. 1), a right side wall 34, and a top wall 36. The cabinet is preferably formed primarily of steel or aluminum but may be formed of other suitable materials as a matter of design choice. The cabinet may be mounted on a pedestal or base support to elevate the cabinet to a desired level or may be placed directly on a floor or slab.

The front wall 28 of the cabinet 14 preferably includes four transparent panels 38, 40, 42, 44 formed of glass or clear plastic which permit viewing of the products 12 stored in the cabinet and observation of the operation of the system. The leftmost 38 and rightmost 44 transparent panels may be hinged at the left side wall 32 and right side wall 34 of the cabinet, respectively, to permit easy access to the interior of the cabinet. The hinged panels are preferably provided with locks to prevent unauthorized entry into the cabinet.

Figure 2:
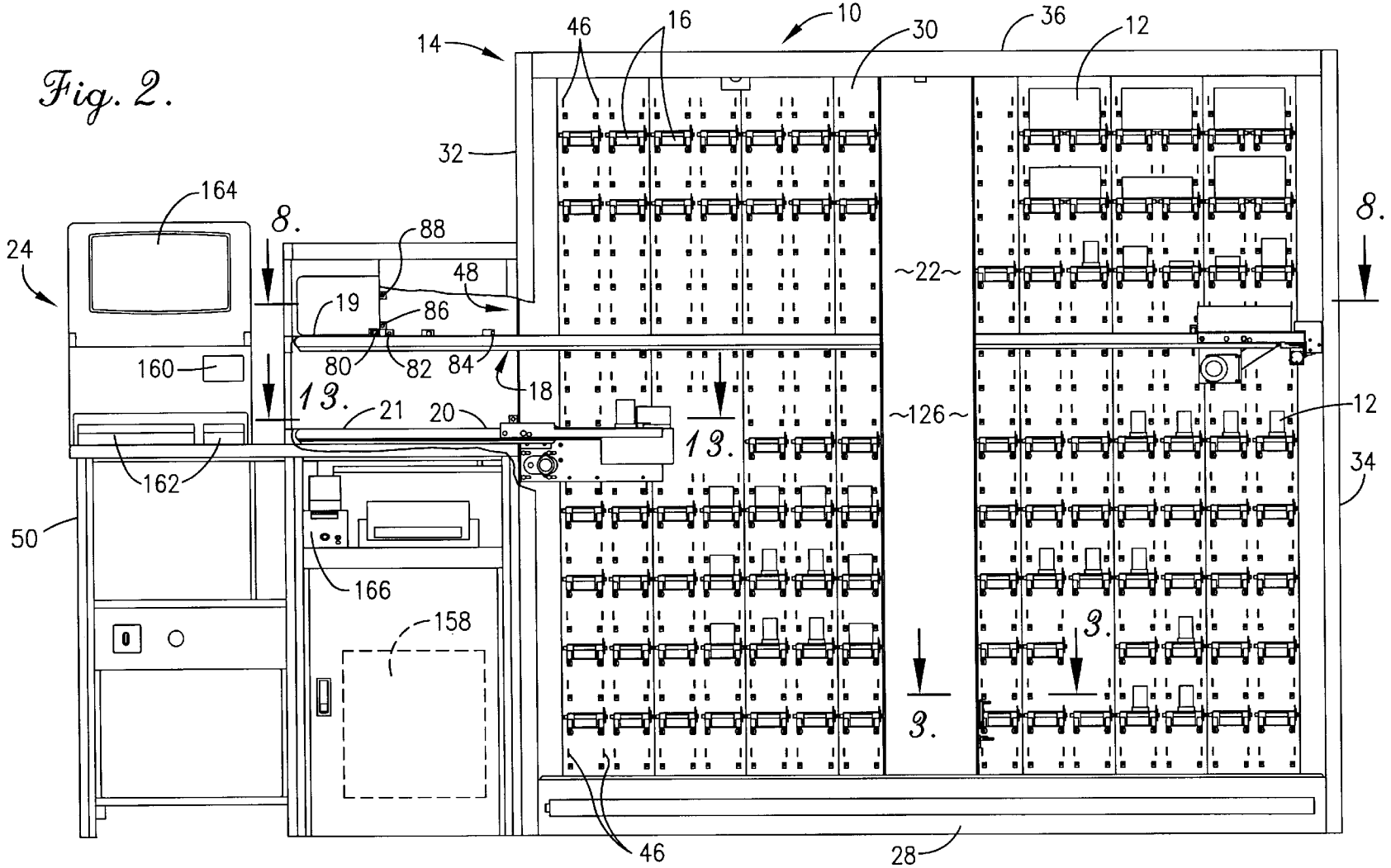
FIG. 2 is a front elevational view of the system with portions broken away.

As best illustrated in FIG. 2, the rear wall 30 of the cabinet 14 includes a series of mounting slots 46 arranged in row and column configuration for use in mounting the product conveyors 16 in the cabinet as described in more detail below. The rear wall may also include mounting hardware for securing the cabinet against a wall or to a support.

An opening 48 is formed in the left side wall 32 of the cabinet 14 to permit the left sides of the infeed conveyor 18 and outfeed conveyor 20 to extend therethrough. A table and cabinetry 50 are preferably positioned adjacent the left side wall near the opening for supporting the components of the control system 24 and for providing a work area for a pharmacist or other operator of the system 10.

Product Conveyors

The product conveyors 16 are provided for holding products 12 stored in the cabinet 14 and are configured to be mounted to the rear wall 30 of the cabinet in a column and row configuration as depicted in FIGS. 1 and 2. Each product conveyor can hold at least one, and normally several products aligned along the length thereof. The product conveyors can each be mounted to any of the slots 46 on the rear wall of the cabinet and can be periodically repositioned to different locations to accommodate different operating schemes. Typically, however, the product conveyors will be pre-positioned during manufacture or installation of the system 10 and will not be repositioned frequently, if at all.

The product conveyors 16 can be arranged in the cabinet 14 to accommodate products 12 of varying sizes and shapes. For example, some of the product conveyors may be mounted individually for narrow products such as pill bottles whereas some of the product conveyors may be ganged or joined together for accommodating wider products such as large boxes. Similarly, some of the product conveyors may be mounted directly below other product conveyors to accommodate relatively short products whereas some of the product conveyors may be spaced further below other product conveyors to accommodate taller products.

Normally one, and sometimes several, of the product conveyors 16 is designated for stock rotation only. These product conveyors are used to temporarily store products that are positioned on the product conveyors in front of other products that need to be dispensed or re-positioned. The stock rotation conveyors are unavailable for long-term storage of products. At least one of the stock rotation product conveyors should be double width and have the maximum height clearance to temporarily store large products.

Figure 3:
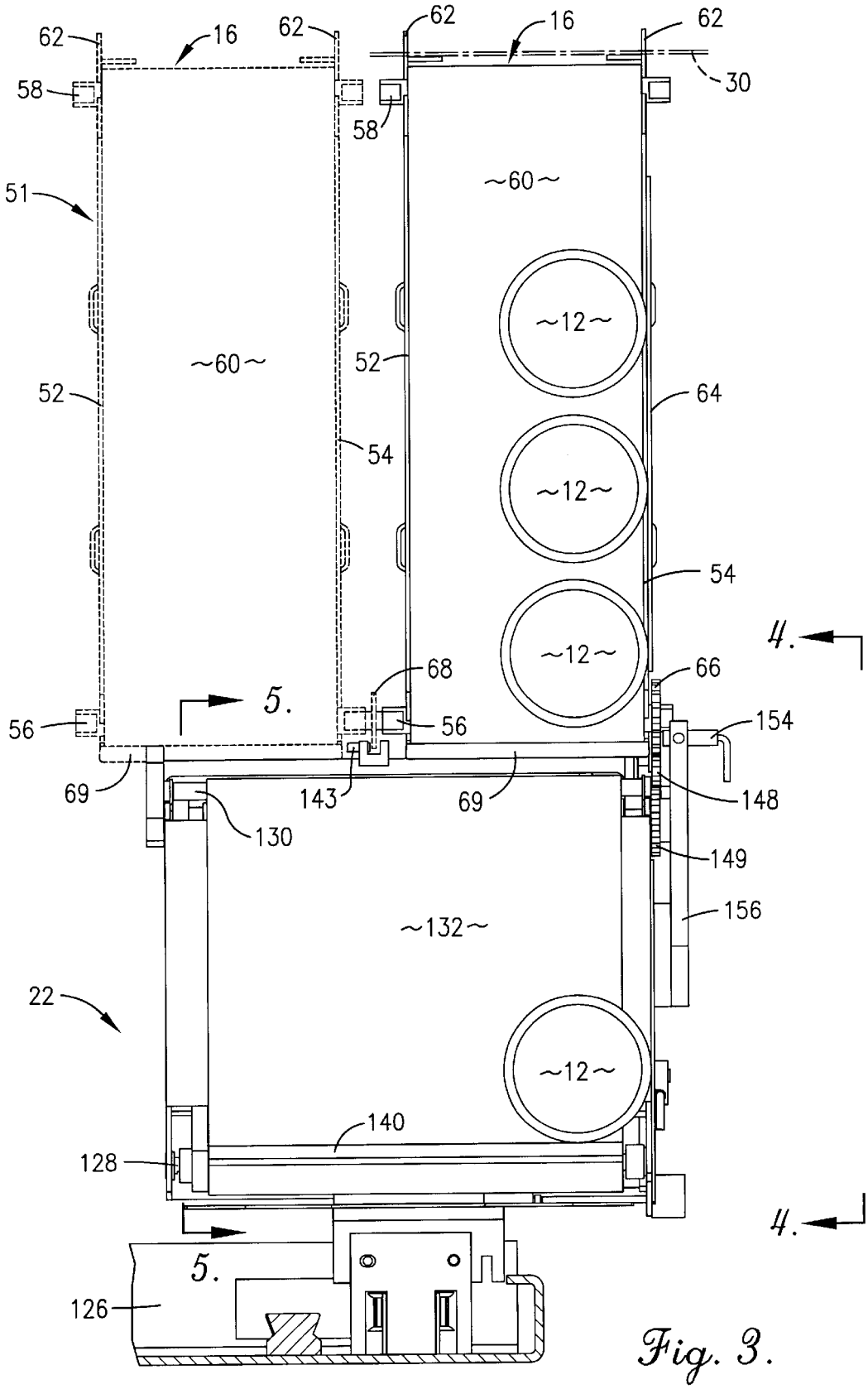
FIG. 3 is a fragmentary, sectional plan view of the transporter and two product conveyors of the system taken along line 3—3 of FIG. 2.
Figures 4, 5:
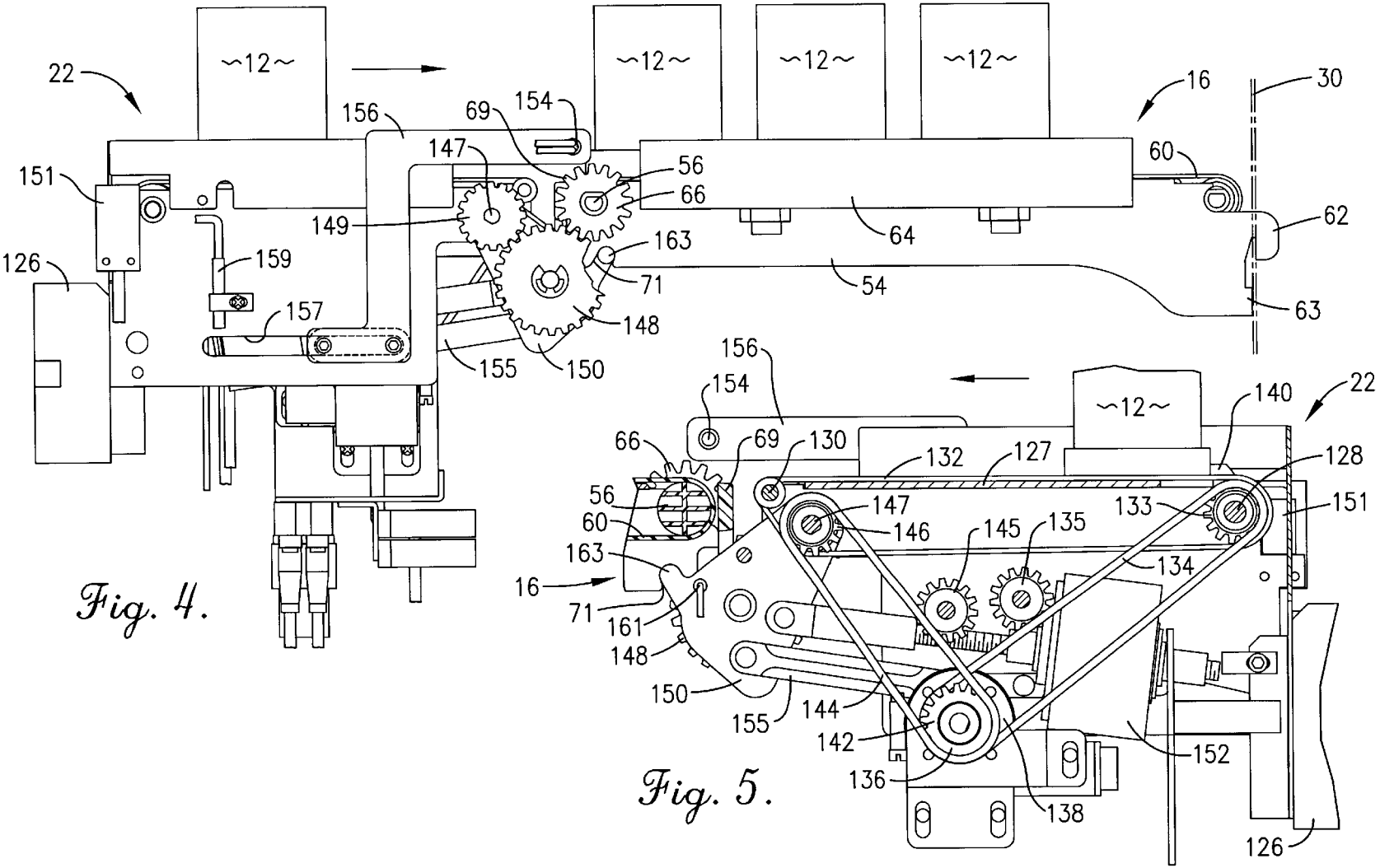
FIG. 4 is a side elevational view of the transporter taken along line 4—4 of FIG. 3 showing the transporter engaging with one of the product conveyors.
FIG. 5 is a sectional view of the transporter taken along 5—5 of FIG. 3 showing the transporter engaging a product conveyor.

As best illustrated in FIGS. 3 and 4, each product conveyor 16 includes a conveyor base 51 having a horizontal base section and a pair of spaced-apart brackets 52, 54 depending therefrom. The conveyor base is preferably formed of metal. A pair of spaced-apart, transversely-extending rollers 56, 58 are rotatably mounted to the conveyor base. A conveyor belt 60 is trained over the rollers so that it covers and rides over the horizontal base section.

Each bracket includes a projecting hook 62 or tab that fits into one of the slots 46 on the rear wall 30 of the cabinet 14. A projecting shoulder 63 formed below each hook abuts against the rear wall when its bracket is attached thereto. A guide wall 64 is preferably attached to the right bracket of each product conveyor for guiding products onto and off the conveyor belt.

A gear 66 is mounted to the front roller 56 of each product conveyor 16 for driving the conveyor belt 60 as described in more detail below. The ends of the rollers 56, 58 are hollow, thus permitting insertion of a joining shaft coupler 68 between two adjacent product conveyors to gang the product conveyors together for handling larger products as best illustrated in FIG. 3. When ganged together in this manner, the conveyor belts of the joined product conveyors are driven by a single gear 66.

A bridge 69 is mounted to the front of each product conveyor 16. The bridge spans part of the gap between its product conveyor and the transporter 22 when the transporter is delivering products to or removing products from the product conveyor to prevent the products from tipping over or becoming misaligned when traveling across the gap.

A groove 71 that serves as a cam follower is formed in the right bracket 54 of each of the product conveyors. The cam follower groove couples with a corresponding cam 163 on the transporter 22 when the transporter is engaged with the product conveyor as best illustrated in FIG. 4.

Infeed Conveyor

The infeed conveyor 18 is provided for loading products 12 into the cabinet 14 that will be subsequently stored on the product conveyors 16. As best illustrated in FIGS. 1 and 2, the infeed conveyor extends transversely across the cabinet between the left 32 and right 34 side walls of the cabinet and includes an infeed section 19 that extends through the opening 48 of the left side wall.

Referring to FIGS. 8–12, the infeed conveyor 18 includes a conveyor base (beneath belt 72), a plurality of rollers 70 (only one shown) rotatably mounted to the base, and a conveyor belt 72 trained across the rollers. The roller 70 nearest the right side wall 34 of the cabinet 14 serves as a drive roller that is driven by a belt 74 or chain rotated by a bi-directional conveyor motor 76. The conveyor motor is controlled by the control system 24 and can move the conveyor belt either forward or backward to move products either into or out of the cabinet. The conveyor motor is mounted below the infeed conveyor belt by a mounting plate 78. The conveyor motor and/or rollers of the infeed conveyor are preferably coupled with an encoder that monitors the position of the conveyor belt to determine the exact position of products 12 placed thereon.

Figure 8:
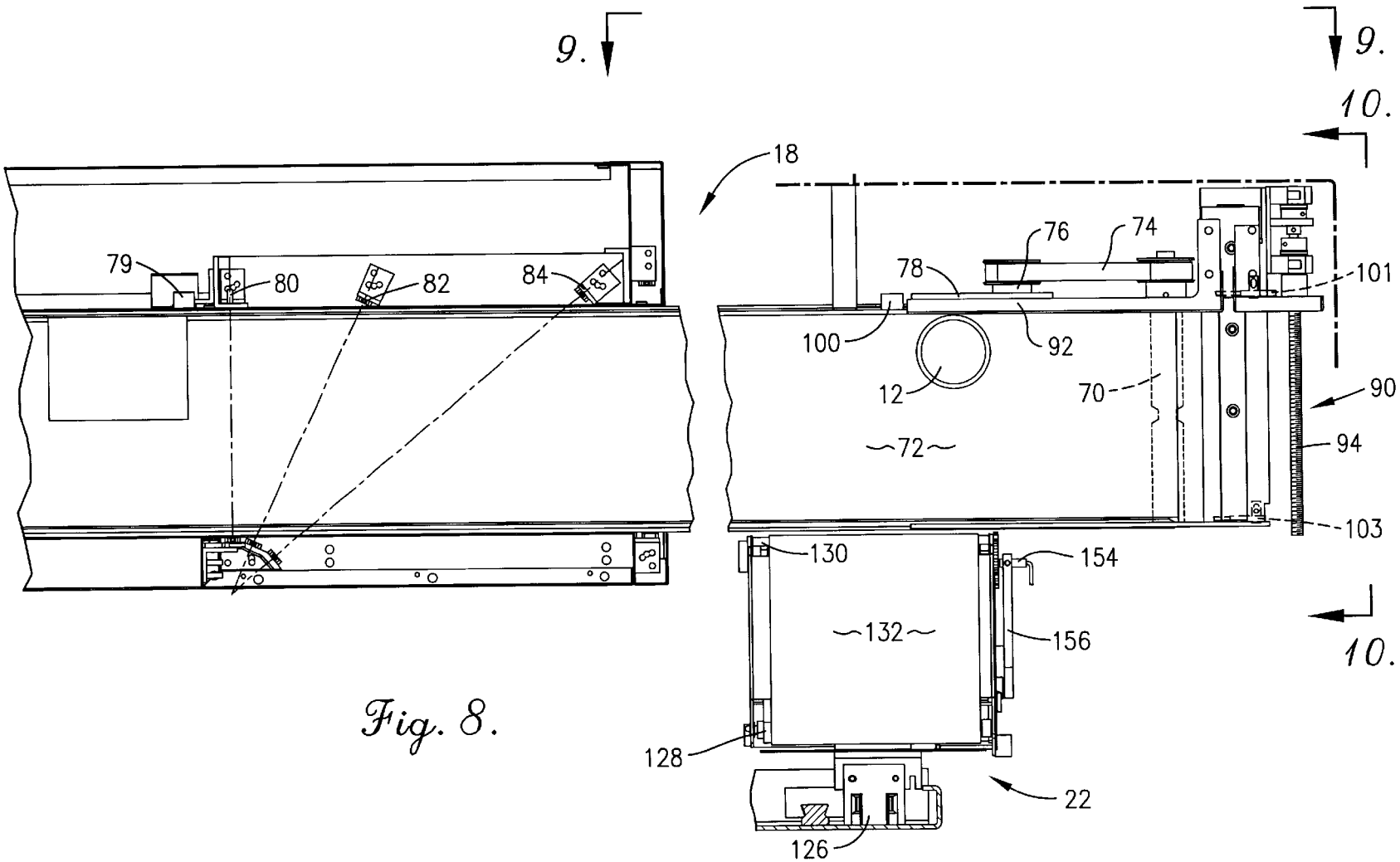
FIG. 8 is a fragmentary plan view of the infeed conveyor and the transporter showing the transporter in position to receive a product from the infeed conveyor.

A plurality of sensors 79, 80, 82, 84 illustrated in FIG. 8 are mounted adjacent the infeed section 19 of the infeed conveyor 18 for sensing the presence, length, and depth of products 12 placed thereon. Particularly, the sensor 79 senses the presence of a product placed on the infeed conveyor as it passes thereby, and the sensors 80, 82, 84 measure the length and depth of the product in conjunction with the positional encoder coupled with the conveyor motor 76. The length and depth of a product is used by the control system 24 to determine on which product conveyor 16 to place the product. The sensors are preferably conventional optical-type sensors each including an optical emitter and an optical detector.

Two additional sensors 86, 88 best illustrated in FIG. 2 are mounted vertically above the infeed section 19 of the infeed conveyor 18 for sensing the height of products 12 loaded thereon. Particularly, the sensor 86 is mounted approximately one inch above the infeed conveyor, and the sensor 88 is mounted approximately four inches above the infeed conveyor. Based on input from the sensors, the control system 24 calculates whether a product is less than one inch tall, between one inch and four inches tall, or greater than four inches tall. Additional height sensors may be used to more accurately determine the height of a product placed on the infeed conveyor. The height of a product is used by the control system 24 to locate a product conveyor 16 having the smallest acceptable height clearance as described in more detail below. The sensors are preferably conventional optical-type sensors each including an optical emitter and an optical detector.

Figures 9, 10:
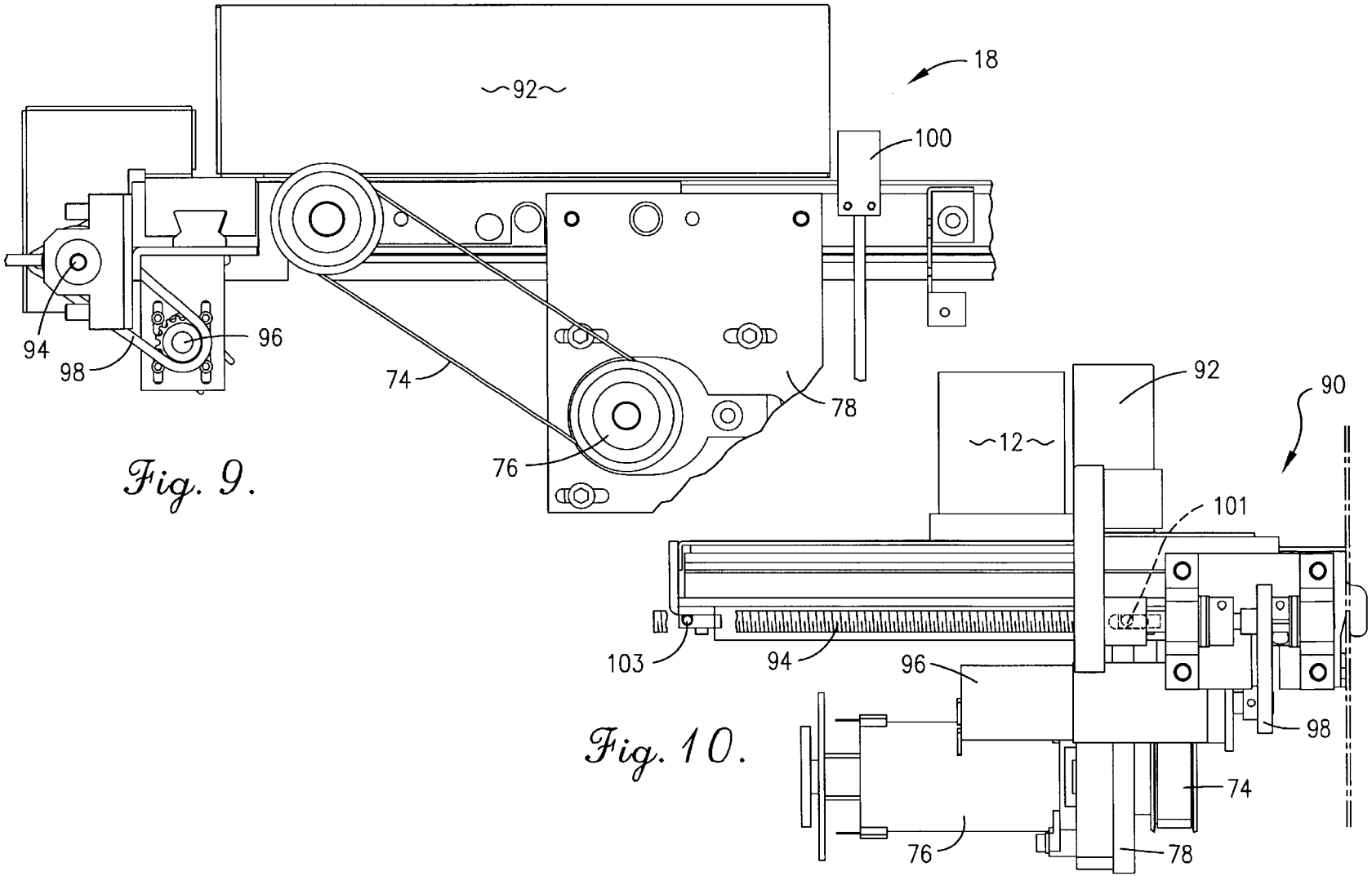
FIG. 9 is a rear fragmentary view of the infeed conveyor taken along 9—9 of FIG. 8.
FIG. 10 is an end view of the infeed conveyor taken along line 10—10 of FIG. 8.
Figure 11:
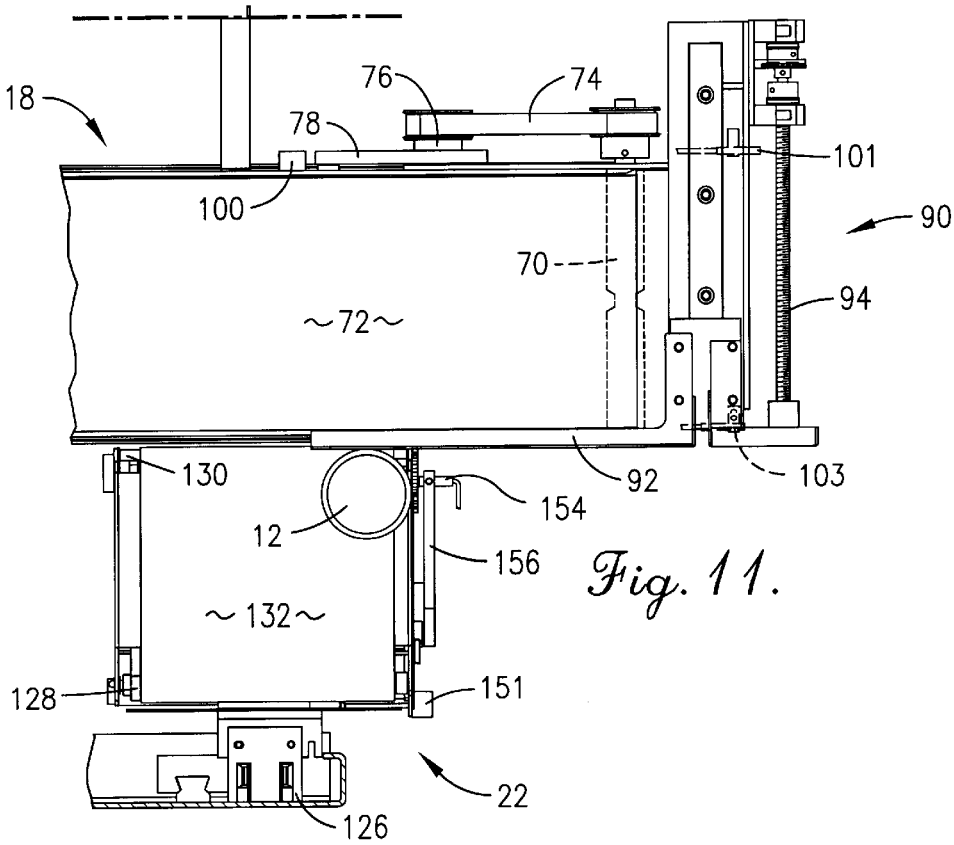
FIG. 11 is a fragmentary plan view of the infeed conveyor showing transfer of a product from the infeed conveyor onto the transporter.
Figure 12:
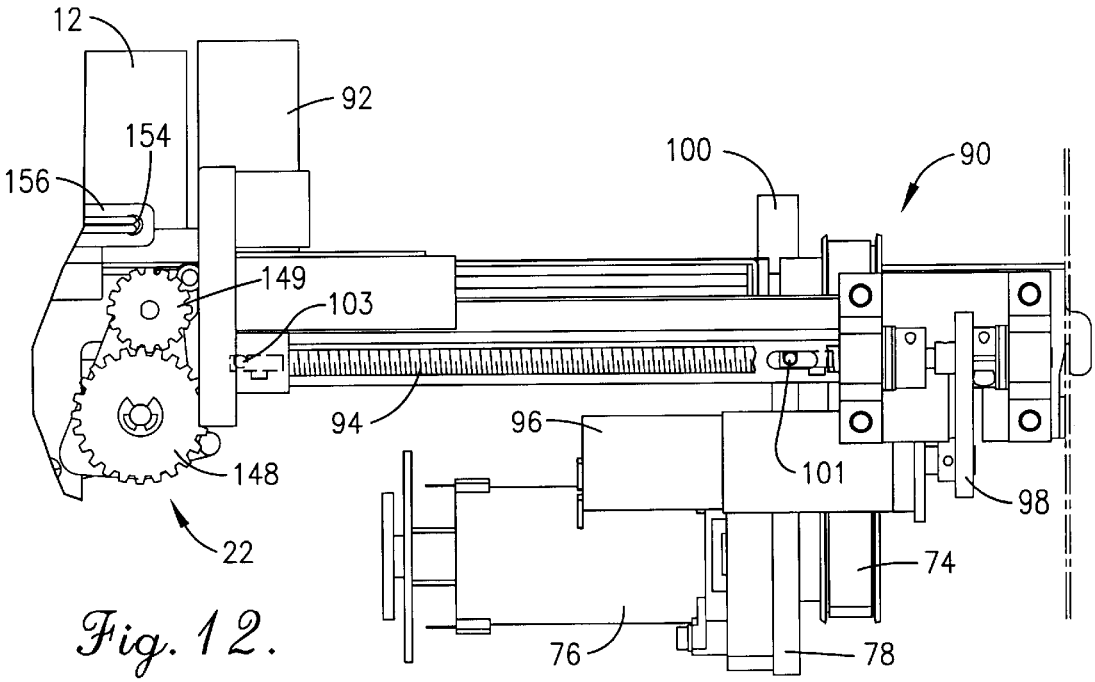
FIG. 12 is an end view of the infeed conveyor similar to FIG. 10 but showing the transfer of a product from the infeed conveyor to the transporter.

Returning to FIGS. 8–12, a moveable ram assembly 90 is mounted adjacent the right end of the infeed conveyor 18. The ram assembly includes a vertically extending ram plate 92 operable to move transversely across the end of the infeed conveyor for pushing products 12 from the infeed conveyor 18 to the transporter 22 as best depicted in FIG. 11. The plate is attached to and driven by a worm or screw gear 94 rotated by a corresponding motor 96 and belt or chain 98 as depicted in FIG. 10.

A sensor 100 is preferably positioned adjacent the left side of the ram plate 92 for sensing when a product 12 has been conveyed in front of the ram plate. A sensor 101 is coupled with the ram assembly 90 for sensing when the ram plate is in its retracted, home position illustrated in FIG. 8. Similarly, a sensor 103 is coupled with the ram assembly for sensing when the ram plate is in its extended position illustrated in FIG. 11.

Outfeed Conveyor

The outfeed conveyor 20 is provided for receiving products 12 from the ransporter 22 and transporting the products out of the cabinet 14 in response to prescriptions received by the control system 24. As best illustrated in FIGS. 1 and 2, the outfeed conveyor extends transversely across the left side of the cabinet 14 and includes an outfeed section 21 that extends through the opening 48 of the left side wall 32 of the cabinet 14. The outfeed conveyor is preferably positioned below the infeed conveyor 18 but may also be positioned above the infeed conveyor as a matter of design choice.

Figure 15:
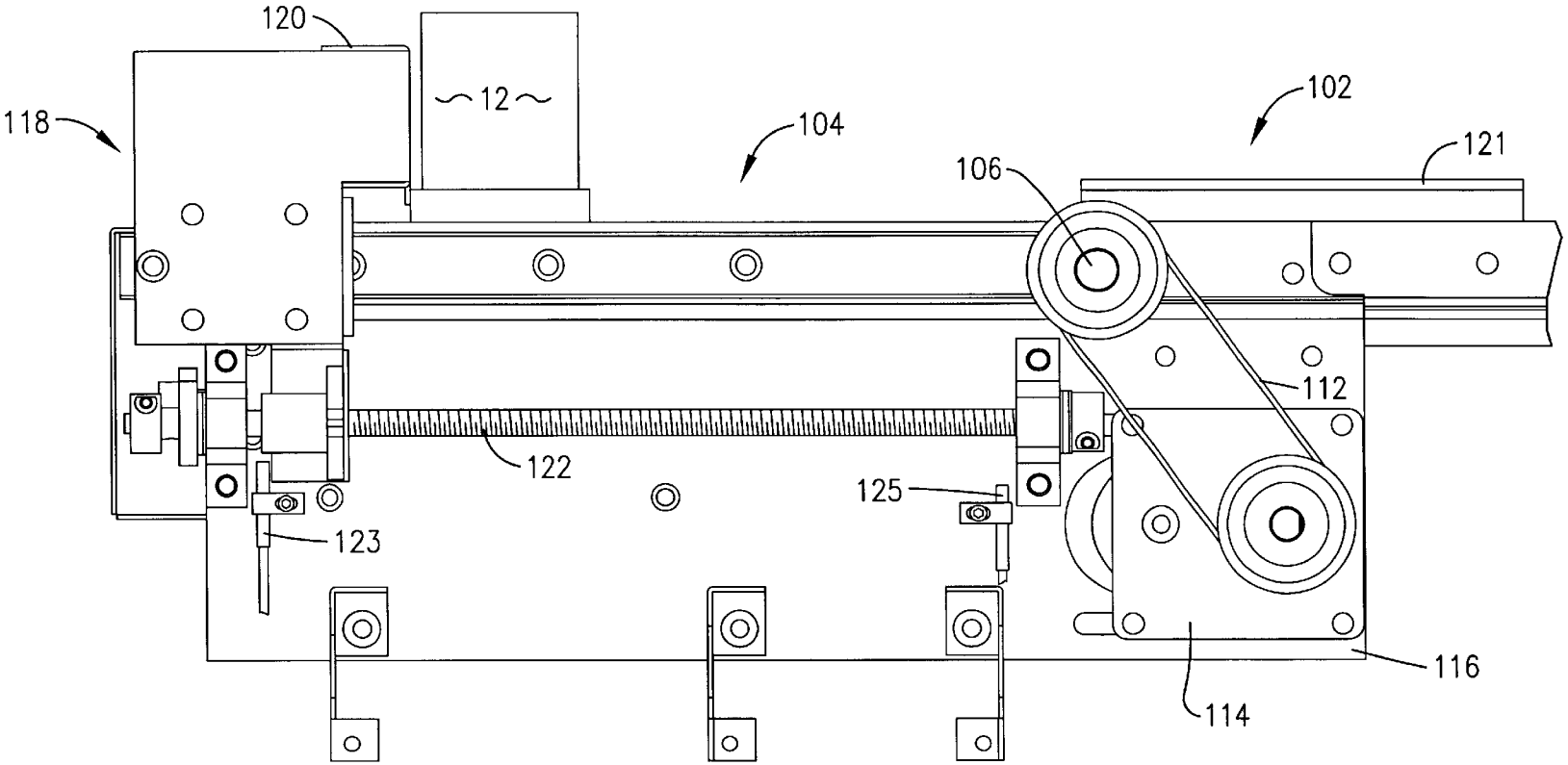
FIG. 15 is a rear elevational view of the outfeed conveyor taken along line 15—15 of FIG. 13.
Figure 16:
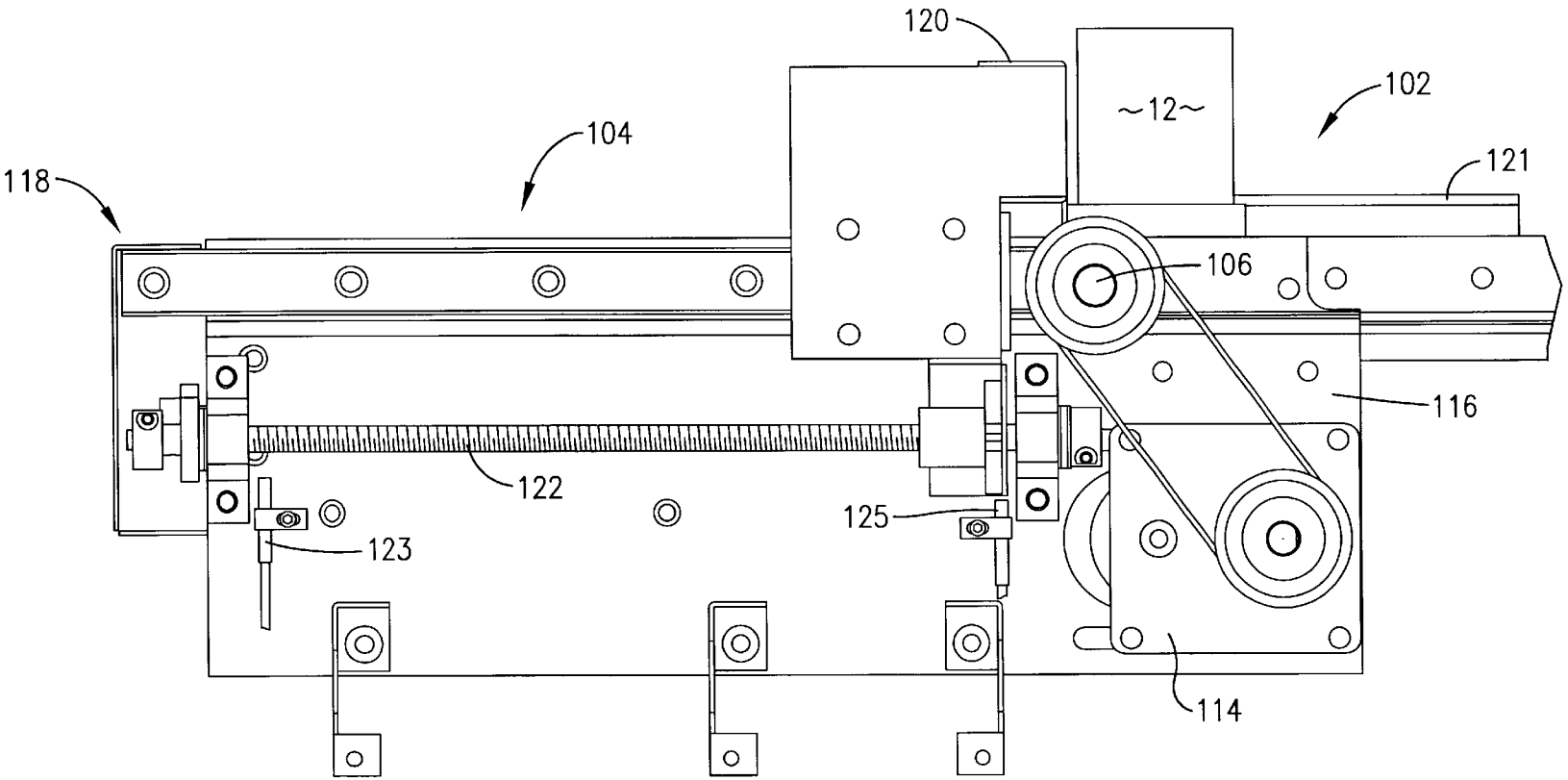
FIG. 16 is a rear elevational view of the outfeed conveyor similar to FIG. 15 except that it depicts the product after it has been moved to the outfeed conveyor belt.
Figure 17:
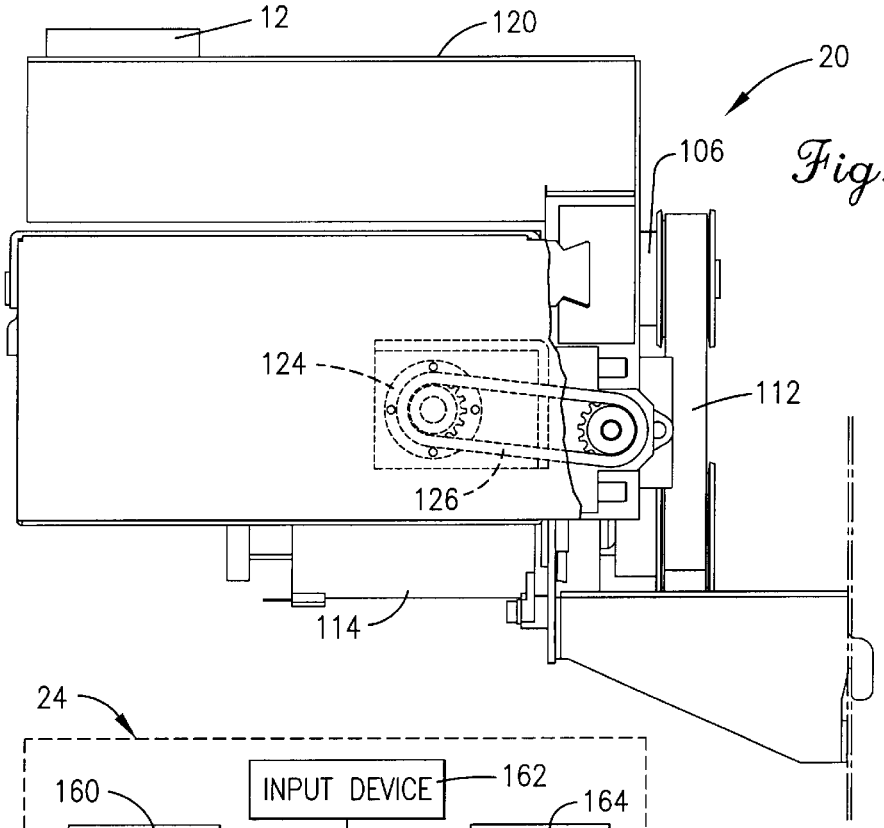
FIG. 17 is a fragmentary end view of the outfeed conveyor with portions broken away taken along line 17—17 of FIG. 14.

As illustrated in FIGS. 13–17, the outfeed conveyor 20 broadly includes a conveyor section 102 and a platform section 104. The conveyor section includes a convey base (below belt 110), a pair of rollers 106,108 rotatably mounted to the ends of the base, and a conveyor belt 110 trained across the rollers. The rightmost roller 106 serves as a drive roller that is driven by a belt or chain 112 rotated by a conveyor motor 114. The conveyor motor is preferably mounted below the conveyor belt by a mounting plate 116 as best illustrated in FIG. 15. The conveyor motor and/or rollers of the outfeed conveyor are preferably coupled with an encoder that, along with the control system 24, verifies the length of a product placed on the outfeed conveyor to ensure that the proper product has been dispensed.

The platform section 104 is positioned adjacent the right side of the conveyor section 102 and is provided for initially receiving products delivered by the transporter 22. A moveable ram assembly 118 is mounted adjacent the platform and includes a vertically-extending plate 120 operable to move longitudinally across the platform toward the conveyor section for pushing products 12 initially placed on the platform onto the conveyor belt 110. The ram plate is attached to and driven by a worm or screw gear 122 rotated by a corresponding motor 124 and belt 126 or chain. As best illustrated in FIG. 14, a wedge-shaped guide 121 may be positioned on the right side of the conveyor section 102 for urging products away from the edge of the conveyor belt 110 as they are pushed onto the belt by the ram plate 120.

Figures 13, 14:
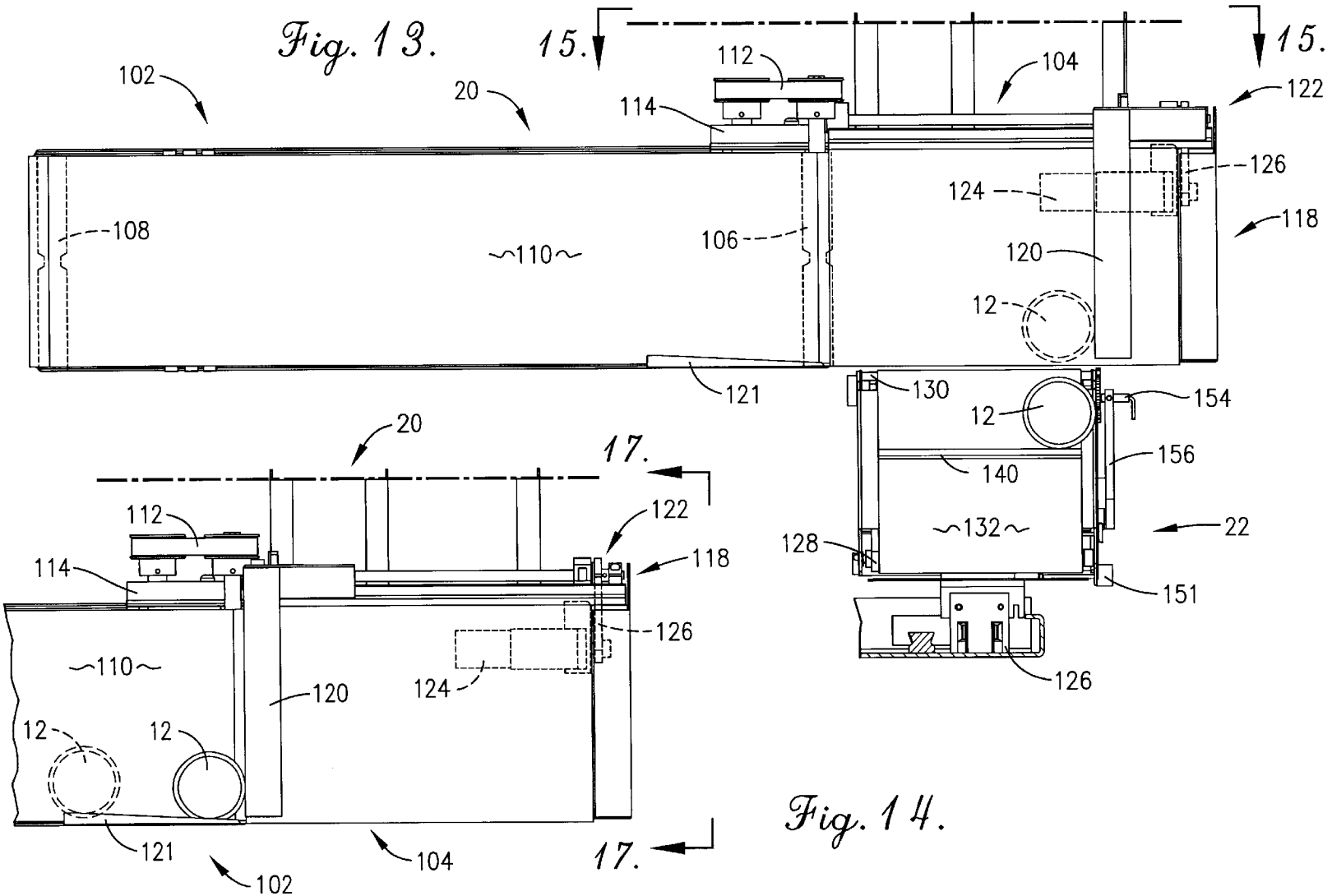
FIG. 13 is a plan view of the outfeed conveyor taken along line 13—13 of FIG. 2 showing a product transferred from the transporter to the platform section of the outfeed conveyor.
FIG. 14 is a fragmentary plan view of the outfeed conveyor showing a product transferred to the outfeed conveyor belt.

A sensor 123 depicted in FIG. 15 is coupled with the ram assembly 118 for sensing when the ram plate 120 is in its retracted, home position illustrated in FIGS. 13 and 15. Similarly, a sensor 125 is coupled with the ram assembly for sensing when the ram plate is in its extended position illustrated in FIGS. 14 and 16.

Transporter

The transporter 22 is provided for transporting products 12 from the infeed conveyor 18 to the product conveyors 16 for storing products in the cabinet and for transporting products from the product conveyors to the outfeed conveyor 20 for dispensing products from the cabinet. The transporter is attached to an X-Y axis drive assembly 126 that moves the transporter under control of the control system 24 both vertically and horizontally within the cabinet so that the transporter can access the infeed and outfeed conveyors and the product conveyors for storing products in and dispensing products from the cabinet. The drive assembly is preferably identical to the drive assembly provided with the SP 200 Medicament Dispensing System manufactured and sold by ScriptPro LLC of Mission, Kans., as described in detail in U.S. Pat. No. 5,337,919, hereby incorporated by reference. The teachings of U.S. Pat. Nos. 5,713,487 and 5,762,235 are also incorporated into the present application by reference.

As illustrated in FIGS. 3–7, the transporter 22 includes a conveyor base 127, a roller 128 and a nose bar 130 rotatably mounted to the ends of the base, and a conveyor belt 132 trained across the roller and nose bar. The roller 128 serves as a drive roller and is attached to a corresponding sprocket 133. The sprocket is rotated by a chain or belt 134 that is driven by a drive sprocket 136 (behind sprocket 142) that is in turn rotated by a motor 138 attached to the bottom of the transporter. The conveyor belt 132 includes an outwardly-extending cleat 140 that engages the bottom of a product placed thereon to aid in pushing the product from the transporter to a product conveyor or to the outfeed conveyor 20.

The nose bar 130 includes a small diameter shaft and a bearing positioned on each end of the shaft. The nose bar allows the end of the transporter conveyor 132 to extend as close to a product conveyor 16 as possible to reduce the gap therebetween as best illustrated in FIG. 5.

Figure 6:
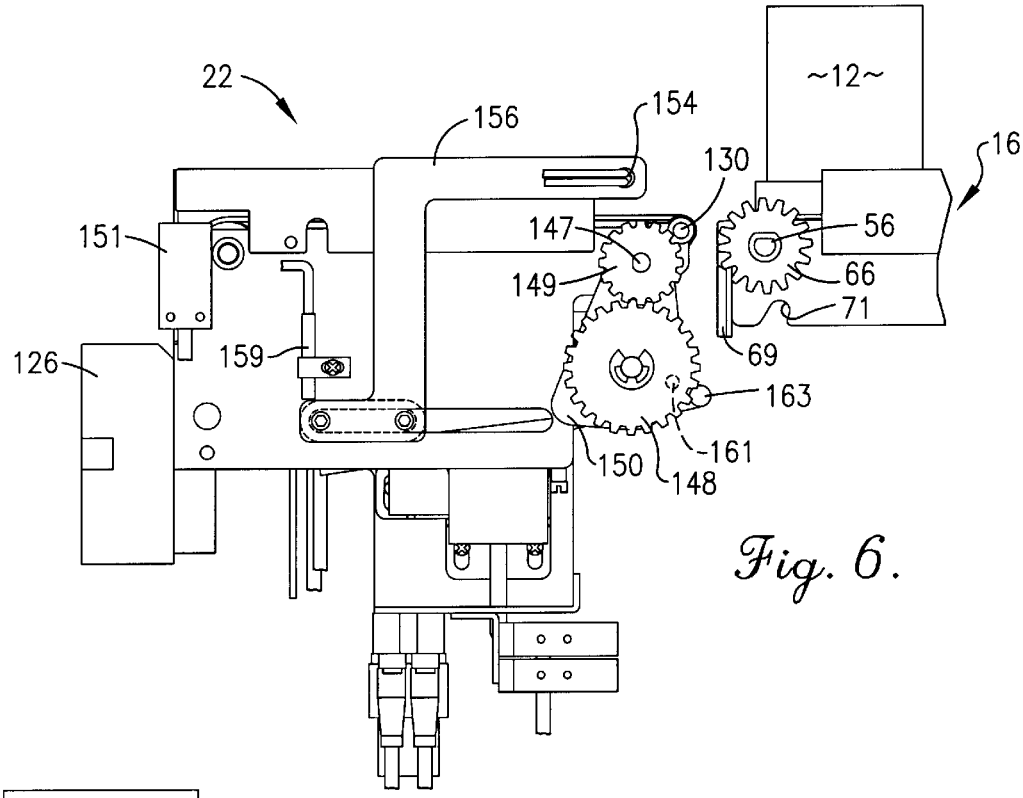
FIG. 6 is a side elevational view of the transporter similar to FIG. 4 except that the transporter is shown retracted relative to the product conveyor.
Figure 7:
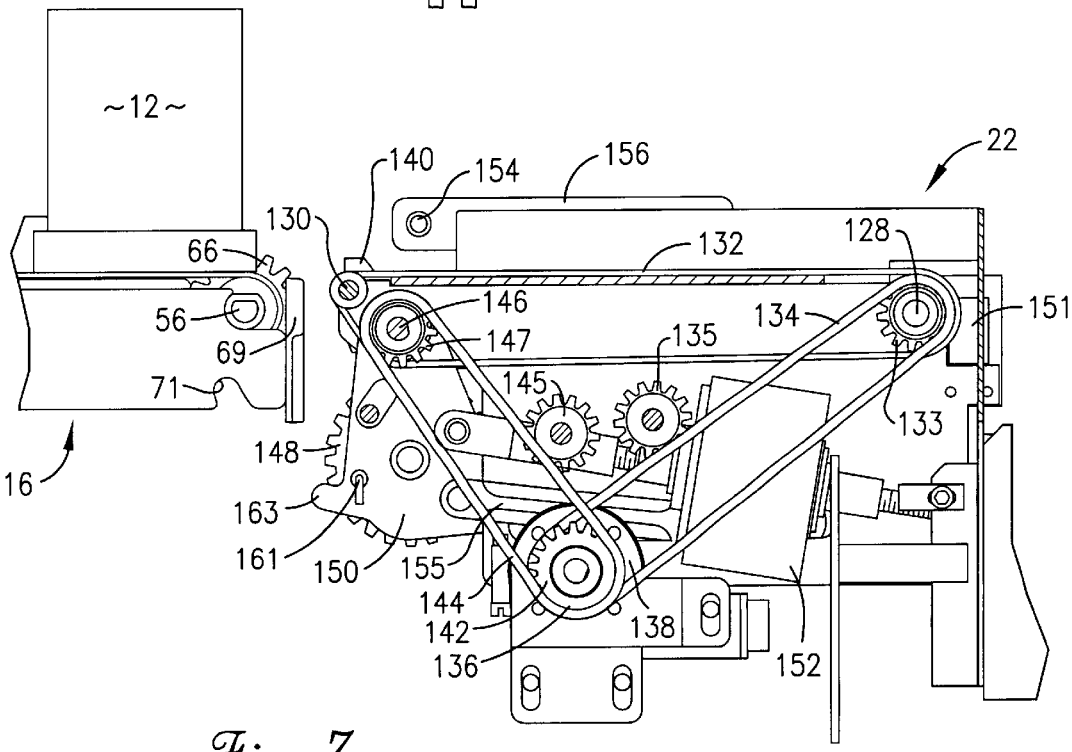
FIG. 7 is a sectional view similar to FIG. 5 except that the transporter is shown in its retracted position.

A sprocket 142 is attached to the shaft of the motor 138 for rotating a chain or belt 144 trained over a sprocket 146 and a corresponding shaft 147 positioned near the front of the transporter 22. A gear 149 is mounted to the opposite side of the shaft as illustrated in FIG. 6. The gear 149 is in turn coupled with a larger gear 148 that is operable to engage the gear 66 on the end of a product conveyor 16. The gear 148 is mounted to a pivot plate 150 that permits it to be extended or retracted relative to the end of the transporter. The belts or chains 134, 144 are preferably tensioned by a pair of sprockets 135, 145.

The gear 148 and pivot plate 150 can be shifted between a retracted, non-engaging position (FIG. 6) and an extended, engaging position (FIG. 4) by a linear actuator 152 mounted to the transporter 22. The actuator as well as the conveyor motor 138 are controlled by the control system 24 so that, as the transporter is positioned adjacent a product conveyor 16, the gear 148 is pivoted outward to its extended position to engage the gear 66 on the product conveyor 16. The motor 138 is then activated to drive both the conveyor belt 60 on the product conveyor 16 and the conveyor belt 132 on the transporter 22. Depending upon the direction of rotation of the motor, the transporter either delivers a product to the product conveyor or retrieves a product therefrom. In preferred forms, the gears 66, 146, 148 are sized so that the conveyor belt 132 on the transporter 22 moves at a slightly faster rate than the conveyor belt 60 on a product conveyor 16 to create a separation between a product being removed from the product conveyor and the next product on the product conveyor.

The transporter also preferably includes a sensor 154 mounted to a support arm 156 extending above the conveyor belt 132 for sensing when a product passes thereby for stopping operation of the motor 138. As illustrated in FIG. 4, the support arm is moveably mounted in a horizontally-extending slot 157 and is coupled with the plate 150 by a connecting link 155. Thus, when the linear actuator 152 moves the gear 148 and plate 150 to their extended, engaged positions, it also shifts the support arm 156 and sensor 154 linearly to the right as viewed in FIG. 4. This places the sensor 154 between the conveyor belt 132 of the transporter and the conveyor belt 60 of the product conveyor to sense when a product passes from one conveyor belt to the other.

The transporter 22 also preferably includes a sensor 151 for sensing when the cleat 140 on the conveyor belt 132 is in its home position near the sensor. The control system 24 typically activates the transporter 22 to position the cleat to its home position before a product is placed thereon. The transporter also preferably includes a sensor 159 for sensing when the linear actuator has shifted the gear 148 and plate 150 to their retracted position (FIG. 6) and a sensor 161 mounted adjacent the cam 163 for sensing when the linear actuator has shifted the gear and plate to their extended positions (FIG. 4). Finally, the transporter preferably includes a sensor 143 for sensing the presence of a joining shaft coupler 68 between two adjacent product conveyors to determine when two product conveyors have been ganged together as illustrated in FIG. 3.

Control System

The control system 24 receives prescriptions from the host computer 26 and controls operation of the conveyors 16, 18, 20 and the transporter 22 in response thereto. The host computer may be any pharmacy computer running a pharmacy automation program such as the one provided by Zadall Computer Systems. As depicted in FIG. 18, the control system broadly includes a controller 158 or computer, a bar code scanner 160 or other indicia reader, an input device 162 such as a keyboard, keypad, fingerprint reader, etc., a display 164 that serves as a operator interface, and a label printer 166.

The controller 158 communicates with and controls operation of the other components of the control system. The controller maintains or accesses several databases 168 or tables which record: the identification and location of all products 12 within the cabinet 14; the type of products that may be stored in and dispensed from the cabinet; and the location and status of each of the product conveyors 16 mounted in the cabinet. For example, the controller maintains a Conveyor Product Table containing information regarding each product that is stored within the cabinet. The following is an example of such a Conveyor Product Table:

| Conveyor Product Table | |
|---|---|
| Conveyor Product ID (Generated by controller) | 001 |
| Machine Conveyor ID (From Machine Conveyor Table) | 50 |
| Conveyor Location (Infeed, Transport, Product) | Infeed |
| Z Ordinal (Location of the product from the end) | 5 |
| Drug Package ID (From Drug Package Table) | 0054472831 |
| UOW (unit of work) ID (Drug Package ID and UOW ID cannot be NULL. or both cannot be set) | 19287 |
| Cx_measured (Measurement in X Dimension) | 100 mm |
| Cy_measured (Measurement in Y Dimension) | 50 mm |
| Cz_measured (Measurement in Z Dimension) | 75 mm |
| Lot # | 002 |
| Expiration Date | Feb. 02, 2000 |
| Date Loaded | Aug. 09, 1999 |

Each product 12 on every product conveyor 16 will have a Conveyor Product Table entry. If the product is a package, it will have a Drug Package ID. If the product is a vial or prepack from a ScriptPro SP 200 medicament dispensing system, it will have a UOW (unit of work) ID (the SP 200 creates the UOW ID).

The Conveyor Product Table includes two date fields: Expiration date and Date loaded. This permits an operator to exclude an expiration date for a loaded product, in which case the product will never expire in the system. However, the operator can still see how long the product has been in the system by the Date loaded field.

The three fields, Cx, Cy, and Cz, are measured by the sensors 80, 82, 84, 86, 88 when a product is brought into the system on the infeed conveyor 18. These help determine on which product conveyor 16 to store the product.

The Lot # field is optional for the operator to fill in. If the operator chooses to leave it blank and chooses the custom option to mix lots, the system 10 will dispense multiple boxes with null lot numbers for a script. If the operator chooses the custom option not to mix lots, the system will only dispense one box with null lot number for one script.

The Z_ordinal determines the position or depth of a product 12 on a product conveyor 16, the infeed conveyor 18, or the transporter 22. If a product is on the infeed conveyor 18, Z_ordinal increments from right to left. If the product is on a product conveyor 16, Z_ordinal increments from back to front. If the product is on the transporter, Z_ordinal is typically to merely indicate the presence of the product thereon. Machine Conveyor ID is the ID of the product conveyor that this product is on or is scheduled to go on. When products are on the infeed conveyor, the Machine Conveyor ID is the product conveyor the product is scheduled to go on. Each product in the system has a unique combination of Machine Conveyor ID, Z_ordinal and Conveyor Location. This ensures that multiple products are not planned to occupy the same space in the system.

The controller 158 also maintains a Drug Package Table containing one entry for each type of product 12 that may be stored in or dispensed from the cabinet 14. An operator may add new entries to the table as new products are introduced into the cabinet, or the table may be populated with entries of all known products during manufacture or installation. An exemplary Drug Package Table is as follows:

| Drug Package Table | |
|---|---|
| Product ID | 0054472831 |
| Size | 100 × 50 × 75 |
| Preferred Orientation | None |
| Default Expiration Date | Jan. 01, 2001 |
| Type | Box |

The Product ID and Size fields contain the same information as the similar fields in the Conveyor Product Table. The Preferred Orientation field is used to identify a preferred orientation of a product on the infeed conveyor so that the product is placed on one of the product conveyors in a particular orientation. The Default Expiration Date field is used to indicate a default expiration date that may be used if no actual expiration date is entered for a product. The Type field indicates whether the product is a rectangular box, oval bottle, round vial, or other shape.

The controller 158 also preferably maintains a Machine Conveyor Table containing one entry for each product conveyor 16 within the cabinet 14. An exemplary Machine Conveyor Table is as follows:

| Machine Conveyor Table | |
|---|---|
| Conveyor ID (Generated by controller) | 3 |
| Col_number | B |
| Row-number | 2 |
| Conveyor_width | 88 mm |
| Conveyor_height (Height above the conveyor) | 100 mm |
| Conveyor_type (New or old for factory revs) | 0 |
| Attribute (for storage, used for rotation, needs reorganization) | 0 |

The Conveyor ID field indicates an ID for a particular product conveyor 16. The Conveyor IDs are typically generated by the controller 158 of the control system 24. The Col_number and Row-number fields indicate the position of a product conveyor within the cabinet 14. The Conveyor_width field indicates the width of a product conveyor, i.e. whether it is a single or double wide conveyor. The Conveyor_height field indicates the amount of free space above each product conveyor 16. The values in the Machine Conveyor are typically calculated and put in the Machine Conveyor Table during installation.

The operator can elect not to mix different kinds of products 12 on a product conveyor 16. If the operator chooses this option, the system 10 only stores one type of product on each product conveyor. If the operator does not choose this option, then each product conveyor can contain several different products with different drugs and different packages, but each product cannot be more than D % (D resides in custom options) different in dimension than the adjacent product (in the X dimension only). Each product Z_ordinal (in Conveyor Product Table) will be in descending order from front to back of the product conveyor. When a product is added to a product conveyor, 1 is added to the Z_ordinal of the existing front product to get the Z_ordinal of the new product. When a product is removed, the Z_ordinal does not change for the remaining products on the product conveyor.

Operation

An operator may use the control system 24 to select any of the following operating modes for operating the system 10: load only, store only, dispense only, dispense and store, dispense and load, and maintenance. The operator can change between operating modes at any time by selecting a new control scheme with the display 164 and input device 162 of the control system 24. When an operator switches operating modes, the system first finishes necessary actions associated with the current mode before proceeding to the next mode.

In the load only mode, the system 10 receives products 12 to be stored in the cabinet 14 and keeps them on the infeed conveyor 18. In the store only mode, the system takes products off the infeed conveyor and puts them on the product conveyors 16.

In the dispense only mode, the system 10 takes products off the product conveyors 16 and puts them on the outfeed conveyor 20 in response to scripts received from the host computer. In the dispense and store mode, dispensing of products takes precedence over storing of products. If the system has scripts to dispense, it completes dispensing products in response to all of the scripts that it can fill and then performs storing of products. If a script comes in during storing, storing is postponed, and the script is filled.

In the dispense and load mode, the system dispenses and loads simultaneously because loading does not require use of the transporter 22. In the maintenance mode, the operator can selectively eject products from the cabinet 14. The loading, storing, dispensing, and maintenance functions are discussed in more detail below.

Loading

Products 12 that are to be loaded in the cabinet 14 must be individually identified by a national drug code (NDC), drug identification number (DIN), UOW (unit of work) ID (for SP 200 pre-packs), or other identification numbers. The identification numbers are preferably bar coded on the products but may also be merely printed thereon.

To load a product 12 into the cabinet 14, an operator first scans the bar code with the bar code scanner 160 or manually enters the identification number via the keyboard or other input device 162. The lot number and expiration date of a product are copied into the Conveyor Product Table when a product is first scanned. If the lot number is not entered, then "null" is entered into the table. If an expiration date is not entered, then a "null" or default value is entered. Once the identification number of a product has been scanned or input, the controller blocks the entry of subsequent identification numbers pending completion of a loading operation.

The operator next places the product 12 on the infeed conveyor 18 and directs the controller 158 to load the product by selecting an icon on the display 164 or by entering information into the controller via the keyboard 162. The control system 24 may also require the operator to place his or her finger on a fingerprint reader or enter a PIN number to ensure that the operator is authorized to load products in the cabinet 14.

The infeed conveyor 18 next conveys the product 12 past the sensors 79, 80, 82, 84, 86, 88 to sense the presence, size and shape of the product for selecting an approximately-sized product conveyor 16 on which to store the product. If the ID on the scanned product does not match an ID in the Drug Package Table, the control system 24 displays a message such as "unrecognized product" on the display 164. The operator may then edit the Drug Package Table to add information for the product or may attempt to load a different product.

The above loading procedures can be performed for several products 12 before any of the products are stored on the product conveyors 16. As each product is loaded, the infeed conveyor 18 advances to the right as viewed in FIG. 1 to make room for additional products. The number of products that can be loaded into the cabinet 14 before the products are stored on the product conveyors is limited only by the number of products that can fit on the infeed conveyor.

Storing

Figure 19:
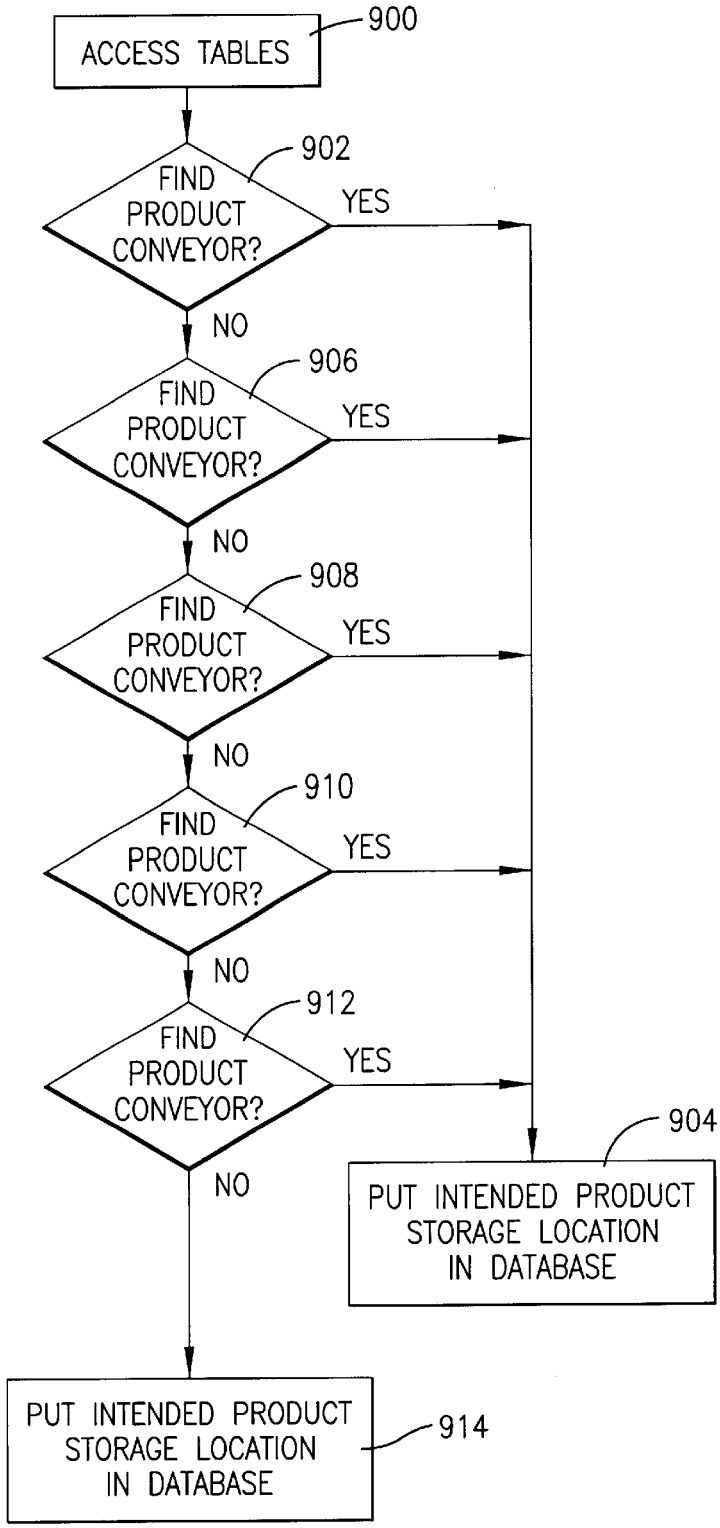
FIG. 19 is a flow diagram illustrating certain steps performed by the control system when storing products within the cabinet.

Once a product 12 or products have been successfully loaded onto the infeed conveyor 18, an operator may initiate a product storing mode. In the storing mode, the control system 24 first identifies a product conveyor 16 on which to store a product and then directs the transporter 22 and ram assembly 90 to remove the product from the infeed conveyor and to transport the product to the selected product conveyor 16. FIG. 19 illustrates an algorithm or program performed by the controller 158 of the control system to select a product conveyor on which to store a product.

The controller first accesses the Conveyor Product Table, Drug Package Table, and Machine Conveyor Table in step 900 to attempt to locate an appropriate product conveyor. For example, the controller first attempts to locate the smallest product conveyor where the product fits that also contains only products having the same package ID and that also has the fewest number of products stored thereon as depicted in step 902.

If such a product conveyor is not found, the program proceeds to step 906 to attempt to find the smallest size product conveyor where the product fits that is also empty. If such a product conveyor is not found, the program proceeds to step 908 where the controller attempts to find the smallest sized product conveyor having a product with the same ID at the front, a maximum number of products with the same ID, and the fewest number of products thereon.

If such a product conveyor is not found, the program proceeds to step 910 where it attempts to find the smallest sized product conveyor where the product fits that also has the same mushable attribute product at the front and the best compatible dimensions and the smallest number of packages stored thereon. If such a product conveyor is not found, the program proceeds to step 912 to attempt to find the smallest sized product conveyor where the product fits that also has the best compatible dimensions and the smallest number of packages thereon.

The compatible dimensions referred to above are the dimensions that will not cause two disproportionate products to be stacked against each other (otherwise, they may skew on the product conveyor). The operator can define the compatible dimensions. For example, the operator may define disproportionate to be 25% so that products that are 25% different in dimensions will not be stacked against one another.

Once a product conveyor 16 is found for storing a product, the controller 158 adds an entry to the Conveyor Product Table for the product. The conveyor ID in the table is set to the ID of the product conveyor found. The control assembly then directs the ram assembly 90 and transporter 22 to move the product to the selected product conveyor as depicted in step 904 of FIG. 19.

Once the product is successfully moved to the product conveyor, the depth or Z_ordinal field is set to indicate the depth of the product on the product conveyor. The conveyor location field in the Conveyor Product Table is set to Infeed when the product is on the infeed conveyor 18. The field will change to Transport when the product is successfully moved to the transporter 22. The field will change to Product Conveyor when the product is successfully transferred to a product conveyor.

If the system is in the middle of a storing routine and it receives a command to load a product, the infeed conveyor will have to move the products back to the left so that only one product is in front of the ram.

Dispensing

Products 12 are dispensed from the cabinet 14 in response to scripts received by the control system 24 from the host computer 26. The controller 158 analyzes a received script and accesses the Conveyor Product Table to locate a product or products to fill the script.

Figure 20:
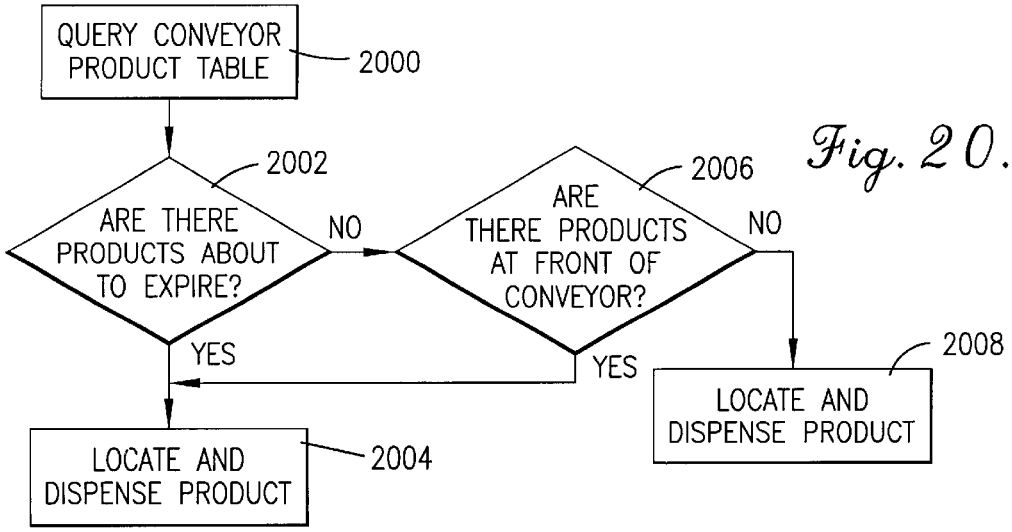
FIG. 20 is a flow diagram illustrating certain steps performed by the control system while dispensing products from the cabinet.

An exemplary algorithm or program run by the controller 158 to locate a product 12 for filling a script is illustrated in FIG. 20. The program first accesses the Conveyor Product Table as depicted in step 2000 to search for a product to fill the script. For example, the controller may first attempt to locate any products that fill the script that are also about to expire as depicted in step 2002. If such a product or products are found, the controller attempts to locate a product or products with: the earliest expiration date; that are the closest to the front of a product conveyor; and that are on a product conveyor of the smallest width and having the smallest clearance height.

If a product that is about to expire is not found, the program proceeds to step 2006 where it attempts to locate a product or products that fill the script that are at the front of a product conveyor. If such a product or products are found, the program once again proceeds to step 2004 to locate a product or products as described above. If no such product or products are found, however, the program attempts to locate a product or products which is the least deep on a product conveyor, which has the earliest expiration date, which is on the smallest width conveyor, which is on the conveyor with the least height clearance, and which is closest to the transporter as depicted in step 2008.

The controller 158 attempts to deliver the least number of products needed to fill a particular script. For example, if a script requires 50 units of a particular product and the cabinet 14 has two boxes each containing 25 of the products and a single box containing 50 units of the product, the controller instructs the transporter 22 to retrieve the 50-count box rather than the two 25-count boxes.

Once a product or products have been selected by the controller 158, the controller directs the transporter 22 to retrieve the product or products from the appropriate product conveyors 16 and to deliver the product or products to the outfeed conveyor 20 for delivery to the operator. The operator then scans or manually enters the ID on the product to ensure that the proper product has been dispensed. The control system 24 then updates the tables to indicate that the product or products have been dispensed and prints a prescription label for the product. The operator applies the label to the product and delivers it to a patient in a conventional manner.

The system 10 may need to rotate products 12 on the product conveyors 16 to retrieve a product that is needed to fill a script. For example, if a product needed to fill a script is not at the front of one of the product conveyors, the system 10 must move all of the products in front of the needed product to another product conveyor reserved for rotation. The products that are temporarily moved may then be moved back to their original product conveyors after the desired product has been dispensed.

An operator may modify an expiration date of a product that is stored in the cabinet by accessing the Conveyor Product Table and changing the entered expiration date. The operator can modify other fields within the table in a similar manner.

Maintenance

The maintenance mode allows an operator to eject selected products 12 from the cabinet 14. The control system 24 allows an operator to eject all of the products from a product conveyor 16, eject a particular product on one of the product conveyors, eject all products within the cabinet, eject only expired products, or eject all products whose loading date is less than some specified date.

The control system controller 158 determines which products are to be ejected and then instructs the transporter 22 to place all specified products on the outfeed conveyor 20. The outfeed conveyor then transports the ejected products to the operator. The control system display 164 may indicate which products need to be ejected before the ejection process begins.

Although the invention has been described with reference to the preferred embodiment illustrated in the attached drawing figures, it is noted that equivalents may be employed and substitutions made herein without departing from the scope of the invention as recited in the claims. For example, although the preferred storage and dispensing system 10 of the present invention includes separate infeed and outfeed conveyors, the functions of the two conveyors may be performed by a single, bi-directional infeed/outfeed conveyor assembly. Or, the infeed and outfeed conveyors may be eliminated entirely, and products may be manually placed on the product conveyors. Similarly, the various conveyors of the system 10, including the product conveyors 16, infeed conveyor 18 and outfeed conveyor 20, may be replaced with equivalent mechanism operable for holding and moving products within the cabinet. Additionally, although the system of the present invention is particularly useful for storing and dispensing pharmaceutical products, it may also be used for storing and dispensing other products and goods.

Having thus described the preferred embodiment of the invention, what is claimed as new and desired to be protected by letters patent includes the following:

1. A storage and dispensing system for storing and dispensing products, the system comprising:

a substantially enclosed cabinet sized and configured to be mounted on a pedestal, base, floor, or slab within a building;

a plurality of product conveyors mounted within the cabinet and each configured for holding at least one product, wherein the cabinet encloses the product conveyors and prevents unauthorized access to the products stored thereon;

an infeed/outfeed mechanism coupled with the cabinet for receiving products that are to be stored in and dispensed from the cabinet; and a transporter enclosed by and moveable within the cabinet for transporting products between the product conveyors and the infeed/outfeed mechanism for storing products in and dispensing products from the cabinet.

2. The system as set forth in claim 1, the infeed/outfeed mechanism including an infeed conveyor for receiving products that are to be stored in the cabinet, and an outfeed conveyor for receiving products that are to be dispensed from the cabinet.

3. The system as set forth in claim 2, further including a control system for controlling operation of the infeed conveyor, the outfeed conveyor, and the transporter.

4. The system as set forth in claim 3, the control system including a controller, a display, an input device, a scanner, and a label printer.

5. The system as set forth in claim 2, further including a plurality of sensors coupled with the infeed conveyor for sensing a physical attribute of products placed on the infeed conveyor.

6. The system as set forth in claim 2, further including a ram assembly coupled with the infeed conveyor for moving products from the infeed conveyor to the transporter.

7. The system as set forth in claim 1, the transporter including a conveyor operable to move products placed thereon to the product conveyors and to remove products from the product conveyors.

8. The system as set forth in claim 7, the transporter further including a motor for moving the conveyor of the transporter.

9. The system as set forth in claim 8, the transporter further including gears powered by the motor, each of the product conveyors including a gear for rotating the product conveyor and operable to engage with the gears of the transporter so that the motor and gears of the transporter rotate the gear of the product conveyor.

10. A storage and dispensing system for storing and dispensing products, the system comprising:

a substantially enclosed cabinet sized and configured to be mounted on a pedestal, base, floor, or slab within a building;

a plurality of product conveyors mounted within the cabinet and each configured for holding at least one product;

an infeed conveyor for receiving products that are to be stored in the cabinet;

an outfeed conveyor for receiving products that are to be dispensed from the cabinet;

a transporter enclosed by and moveable within the cabinet for transporting products between the infeed conveyor and the product conveyors and between the product conveyors and the outfeed conveyor for storing products in or dispensing products from the cabinet; and a control system for controlling operation of the infeed conveyor, the outfeed conveyor, and the transporter.

11. The system as set forth in claim 10, further including a plurality of sensors coupled with the infeed conveyor for sensing a physical attribute of products placed on the infeed conveyor.

12. The system as set forth in claim 10, further including a ram assembly coupled with the infeed conveyor for moving products from the infeed conveyor to the transporter.

13. The system as set forth in claim 10, the transporter including a conveyor operable to move products placed thereon to the product conveyors and to remove products from the product conveyors.

14. The system as set forth in claim 13, the transporter further including a motor for moving the conveyor of the transporter.

15. The system as set forth in claim 14, the transporter further including gears powered by the motor, each of the product conveyors including a gear for rotating the product conveyor and operable to engage with the gears of the transporter so that the motor and gears of the transporter rotate the gear of the product conveyor.

16. The system as set forth in claim 10, the control system including a controller, a display, an input device, a scanner, and a label printer.

17. A storage and dispensing system for storing and dispensing products, the system comprising:

a substantially enclosed cabinet sized and configured to be mounted on a pedestal, base, floor, or slab within a building;

a plurality of product holding mechanisms mounted within the cabinet and each configured for holding at least one product;

an infeed/outfeed mechanism coupled with the cabinet for receiving products that are to be stored in and dispensed from the cabinet; and a transporter enclosed by and moveable within the cabinet for transporting products between the infeed/outfeed mechanism and the product holding mechanisms for storing products in and dispensing products from the cabinet.

18. A storage and dispensing system for storing and dispensing medical products, the system comprising:

a substantially enclosed cabinet sized and configured to be mounted on a pedestal, base, floor, or slab within a building;

a plurality of product conveyors mounted within the cabinet and each configured for holding a plurality of medical products, the product conveyors being arranged within the cabinet so that medical products of various sizes may be stored within the cabinet;

an infeed/outfeed mechanism coupled with the cabinet for receiving medical products that are to be stored in and dispensed from the cabinet; and a transporter enclosed by and moveable within the cabinet for transporting medical products between the product conveyors and the infeed/outfeed mechanism for storing medical products in and dispensing medical products from the cabinet.

19. The system as set forth in claim 18, the infeed/outfeed mechanism including an infeed conveyor for receiving products that are to be stored in the cabinet, and an outfeed conveyor for receiving products that are to be dispensed from the cabinet.

20. The system as set forth in claim 19, further including a control system for controlling operation of the infeed conveyor, the outfeed conveyor, and the transporter.

21. A storage and dispensing system for storing and dispensing products, the system comprising:

a cabinet including a front wall, a rear wall, a left sidewall, a right sidewall, and a top wall that together substantially enclose the cabinet and prevent unauthorized access therein, wherein the front wall is hinged so that it may be opened to gain access to the interior of the cabinet and includes a plurality of transparent panels so that the products stored within the cabinet may be viewed from outside of the cabinets;

a plurality of product conveyors mounted within and enclosed by the cabinet and each configured for holding at least one product;

an infeed/outfeed mechanism coupled with the cabinet for receiving products that are to be stored in and dispensed from the cabinet; and a transporter enclosed by and moveable within the cabinet for transporting products between the product conveyors and the infeed/outfeed mechanism for storing products in and dispensing products from the cabinet.

22. A storage and dispensing system for storing and dispensing products, the system comprising:

a cabinet including a front wall, a rear wall, a left sidewall, a right sidewall, and a top wall that together substantially enclose the cabinet and prevent unauthorized access therein, wherein the rear wall of the cabinet includes a series of mounting slots arranged in row and column configuration;

a plurality of product conveyors mounted within and substantially enclosed by the cabinet and each configured for holding at least one product, wherein each of the product conveyors is mounted within certain ones of the mounting slots and may be removed and mounted to other ones of the mounting slots to reconfigure placement of the product conveyors within the cabinet;

an infeed/outfeed mechanism coupled with the cabinet for receiving products that are to be stored in and dispensed from the cabinet; and a single transporter enclosed by and moveable within the cabinet for transporting products between the product conveyors and the infeed/outfeed mechanism for both storing products in and dispensing products from the cabinet.

23. A storage and dispensing system for storing and dispensing products, the system comprising:

a cabinet including a front wall hinged so that it may be opened to gain access to the interior of the cabinet and including a plurality of transparent panels so that the products stored within the cabinet may be viewed from outside of the cabinet;

a plurality of product conveyors mounted within and substantially enclosed by the cabinet and each configured for holding at least one product;

an infeed/outfeed mechanism coupled with the cabinet for receiving products that are to be stored in and dispensed from the cabinet; and a single transporter enclosed by and moveable within the cabinet for transporting products between the product conveyors and the infeed/outfeed mechanism for both storing products in and dispensing products from the cabinet.

* * * * *